US007717081B2

(12) United States Patent
Yamada

(10) Patent No.: US 7,717,081 B2
(45) Date of Patent: May 18, 2010

(54) ENGINE CYLINDER HEAD STRUCTURE

(75) Inventor: Shinji Yamada, Shizuoka-ken (JP)

(73) Assignee: Suzuki Motor Corporation, Hamamatsu-shi (JP)

( * ) Notice: Subject to any disclaimer, the term of this patent is extended or adjusted under 35 U.S.C. 154(b) by 430 days.

(21) Appl. No.: 11/876,392

(22) Filed: Oct. 22, 2007

(65) Prior Publication Data

US 2008/0092843 A1 Apr. 24, 2008

(30) Foreign Application Priority Data

Oct. 24, 2006 (JP) ..... 2006-288282

(51) Int. Cl.
*F01M 1/06* (2006.01)

(52) U.S. Cl. ..... 123/196 R; 123/90.15; 123/193.5

(58) Field of Classification Search ..... 123/193.5, 123/193.3, 90.15–90.18, 196 R, 196 M
See application file for complete search history.

(56) References Cited

U.S. PATENT DOCUMENTS 6,263,844 B1 * 7/2001 Ozeki et al. ..... 123/90.17
6,295,964 B1 * 10/2001 DiMaria et al. ..... 123/196 R
6,546,906 B2 * 4/2003 Ozeki ..... 123/196 R
6,823,825 B1 * 11/2004 Hwang et al. ..... 123/90.15

FOREIGN PATENT DOCUMENTS

JP 2000110536 A 4/2000
JP 2000199417 A 7/2000

* cited by examiner

*Primary Examiner*—M. McMahon
(74) *Attorney, Agent, or Firm*—Marsh, Fischmann & Breyfogle LLP

(57) ABSTRACT

In a cylinder head structure of an engine, a structure of an oil passage is simplified to downside the engine and to provide proper flow of cooling water in the cylinder head. A partition wall is disposed in the cylinder head to separate an upward valve operating chamber from a downward water jacket. A boss section is formed at a position lower than the partition wall in an edge wall of the cylinder head, and has one end joined to a chain case and the other end protruding into the water jacket. A branch oil passage is formed in the boss section. The branch oil passage has a valve upstream-side passage section specified by a section toward the chain case with respect to a junction with a cylinder head-side oil passage. The linear communication passage section communicates between an end portion of the branch oil passage protruding into the water jacket and a camshaft cap coupling surface of a second camshaft bearing section.

3 Claims, 8 Drawing Sheets

ENGINE CYLINDER HEAD STRUCTURE

FIELD OF THE INVENTION

This invention relates to a structure of a cylinder head of an engine, and more particularly to a structure of the cylinder head of an engine with a variable valve timing mechanism.

BACKGROUND OF THE INVENTION

An engine with a hydraulically-driven variable valve timing mechanism includes an actuator disposed at an end of a camshaft, an actuator oil passage as an operating oil path for introducing oil from an oil pump to the actuator, and a camshaft oil passage as a lubricating oil path for introducing the oil to the camshaft.

Conventionally, an engine comprises structures forming an oil passage for the engine, which include an operating oil path in communication to an end journal at an end of a camshaft in a cylinder head to introduce the oil to an actuator for a variable valve timing mechanism, and a camshaft lubricating oil path in communication to a camshaft housing of a journal adjacent to the end journal.

Also there are some structures of an oil passage for the engine, which include an operating oil path in communication to a camshaft housing journal section of the end journal of the camshaft to introduce the oil to the actuator for the variable valve timing mechanism, and a lubricating oil path also in communication to the end journal of the camshaft.

Prior Art

The following documents 1 and 2 form the prior art of which the present applicant has presently knowledge Document 1: JP No. 2000-110536A Document 2: JP No. 2000-199417A

DISCLOSURE OF THE INVENTION

Problems to be Solved by the Invention

Conventionally, in the structure of the oil passage as disclosed in JP No. 2000-110536A, an oil pipe is disposed in the lubricating oil path of the camshaft. It therefore increases the number of components and also requires arrangement of oil pipes so as not to interfere with the camshaft and a cylinder head cover, resulting in constraint of layout.

Also according to JP No. 2000-199417A, the end journal of the camshaft is increased in length to disadvantageously lengthen the engine. Where the end journal is made shorter in length, the operating oil pressure for the variable valve timing mechanism cannot be fully obtained.

To obviate above-mentioned inconveniences in a cylinder head of an engine equipped with a variable valve timing mechanism, the present invention provides a simplified structure of an oil passage including an actuator oil passage for introducing the oil to an actuator for the variable valve timing mechanism and a camshaft bearing oil passage for lubricating a camshaft bearing section of a camshaft, while fully obtaining the operating oil pressure for the variable valve timing mechanism. This reduces the number of components and allows the cylinder head to be made smaller in size to downsize the engine, which promotes productivity. A boss section having the oil passage therein provides proper flow of cooling water in the cylinder head.

Means to Solve the Problems

The present invention provides a structure of a cylinder head of an engine, having more than one camshaft bearing section formed on top of the cylinder head and arranged in an axial direction of a camshaft, the camshaft bearing section rotatably supporting the camshaft; an actuator of a variable valve timing mechanism attached to the camshaft at a protruding section from an edge wall of the cylinder head; an oil control valve disposed in a chain case that covers the edge wall of the cylinder head; a cylinder head-side oil passage formed in the edge wall of the cylinder head by which oil is supplied from the cylinder block side, the cylinder head-side oil passage having a downstream end branched into an actuator oil passage in communication to the actuator through the oil control valve and a camshaft bearing oil passage in communication to the camshaft bearing section; a valve upstream-side passage section formed in the edge wall of the cylinder head as the actuator oil passage for communicating between the cylinder head-side oil passage and the oil control valve; a valve downstream-side passage section for communicating between the oil control valve and a first camshaft bearing section above the edge wall of the cylinder head; a communication passage section as the camshaft bearing oil passage for communicating the cylinder head-side oil passage with a second camshaft bearing section adjacent to the first camshaft bearing section in the axial direction of the camshaft, comprising the improvement wherein a partition wall is disposed in the cylinder head to separate an upward valve operating chamber from a downward water jacket; a boss section is formed at a position lower than the partition wall in the edge wall of the cylinder head, and has one end joined to the chain case and the other end protruding into the water jacket; a branch oil passage is formed in the boss section and extends linearly into the water jacket from a joint surface with the chain case, and has a middle section to which the cylinder head-side oil passage is connected, the branch oil passage having the valve upstream-side passage section specified by a section toward the chain case with respect to a junction Keith the cylinder head-side oil passage; and the linear communication passage section communicates between an end portion of the branch oil passage protruding into the water jacket and a camshaft cap coupling surface of the second camshaft bearing section.

Effects of the Invention

According to the structure of the cylinder head of the engine of the present invention, the oil passage structure including the actuator oil passage and the camshaft bearing oil passage can be simplified while fully maintaining the operating oil pressure to the variable valve timing mechanism, reducing the number of components and providing a smaller cylinder head to downsize the engine promoting productivity. The boss section having the oil passage therein provides proper flow of cooling water in the cylinder head.

BEST MODE FOR CARRYING OUT THE INVENTION

In order to downside the engine and to promote productivity, the present invention provides the simplified structure of the oil passage including the actuator oil passage for conducting the oil to the actuator of the variable valve timing mechanism and the camshaft bearing oil passage for lubricating the camshaft bearing section. In order to provide proper flow of the cooling water in the cylinder head, the present invention provides the boss section having the oil passage therein.

Embodiments of the present inventions are explained in detail with reference to drawings.

DETAILED DESCRIPTION OF A FIRST EMBODIMENT OF THE INVENTION

Figure 6:
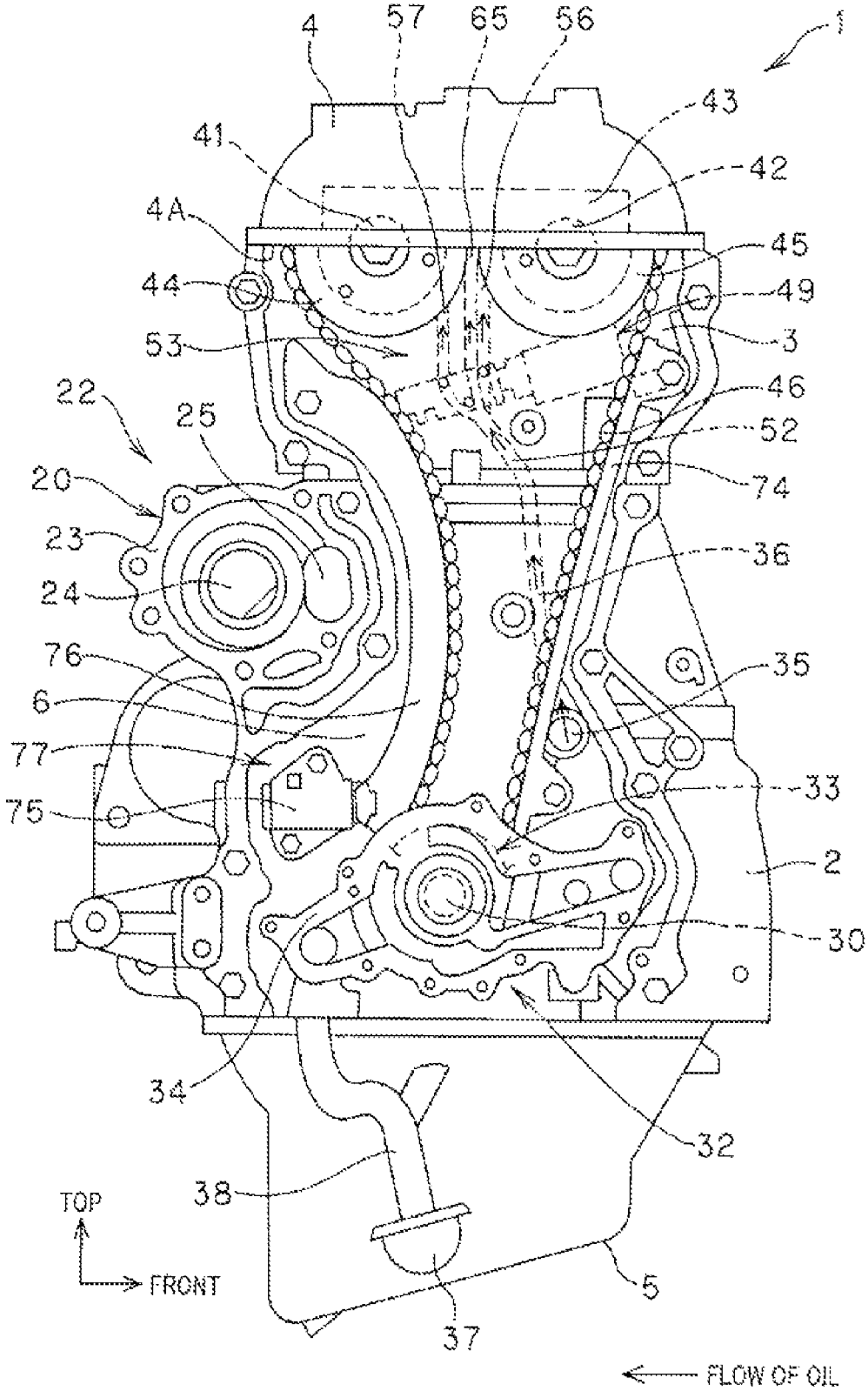
FIG. 6 is a right side view of an engine from which a chain case is detached according to a first embodiment of the present invention.
Figure 7:
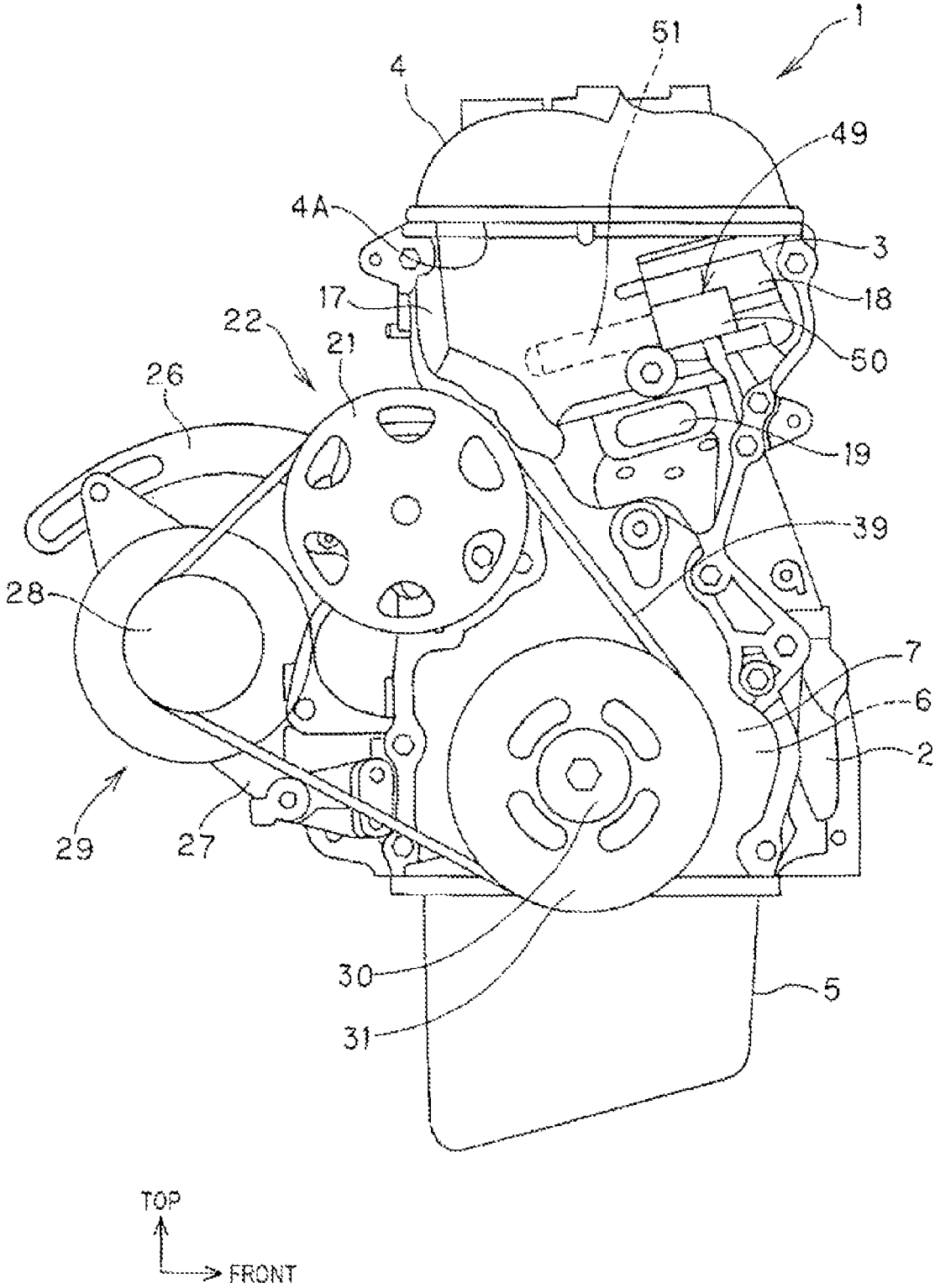
FIG. 7 is a right side view of an engine according to a first embodiment of the present invention.

FIGS. 1-5 illustrate a first embodiment of the present invention. FIGS. 6 and 7 show a multi-cylinder engine 1 for mounting on a vehicle.

Figure 1:
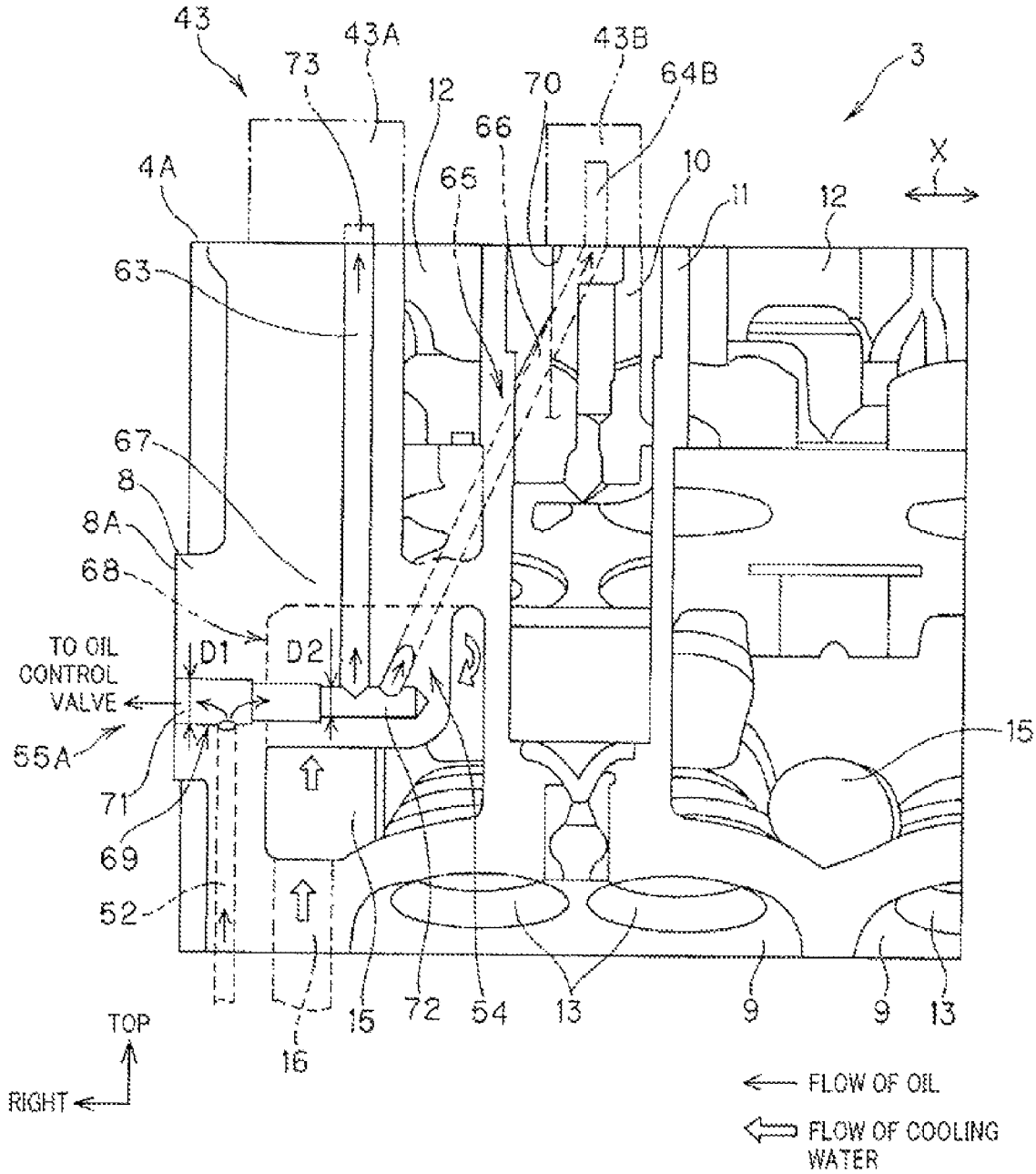
FIG. 1 is a cross-sectional view of a cylinder head taken along line 1-1 of FIG. 2.

The engine 1 is installed transversely of the vehicle and includes a cylinder block 2, a cylinder head 3, a cylinder head cover 4, and an oil pan 5. To the engine 1, a chain case 7 is attached which defines a chain chamber 6 over a right side of the cylinder block 2 and the cylinder head 3. As shown in FIG. 1, the chain case 7 is joined to a joining surface 8A of an edge wall 8 of the cylinder head 3.

Referring to FIG. 1, the cylinder head 3 has combustion chambers 9, corresponding to respective cylinders, formed in a lower section thereof. The cylinder head 3 also has in an upper section an ignition plug hole wall 11 defining an ignition plug hole 10, and a valve operating chamber 12 on the periphery of the ignition plug hole wall 11.

Figure 5:
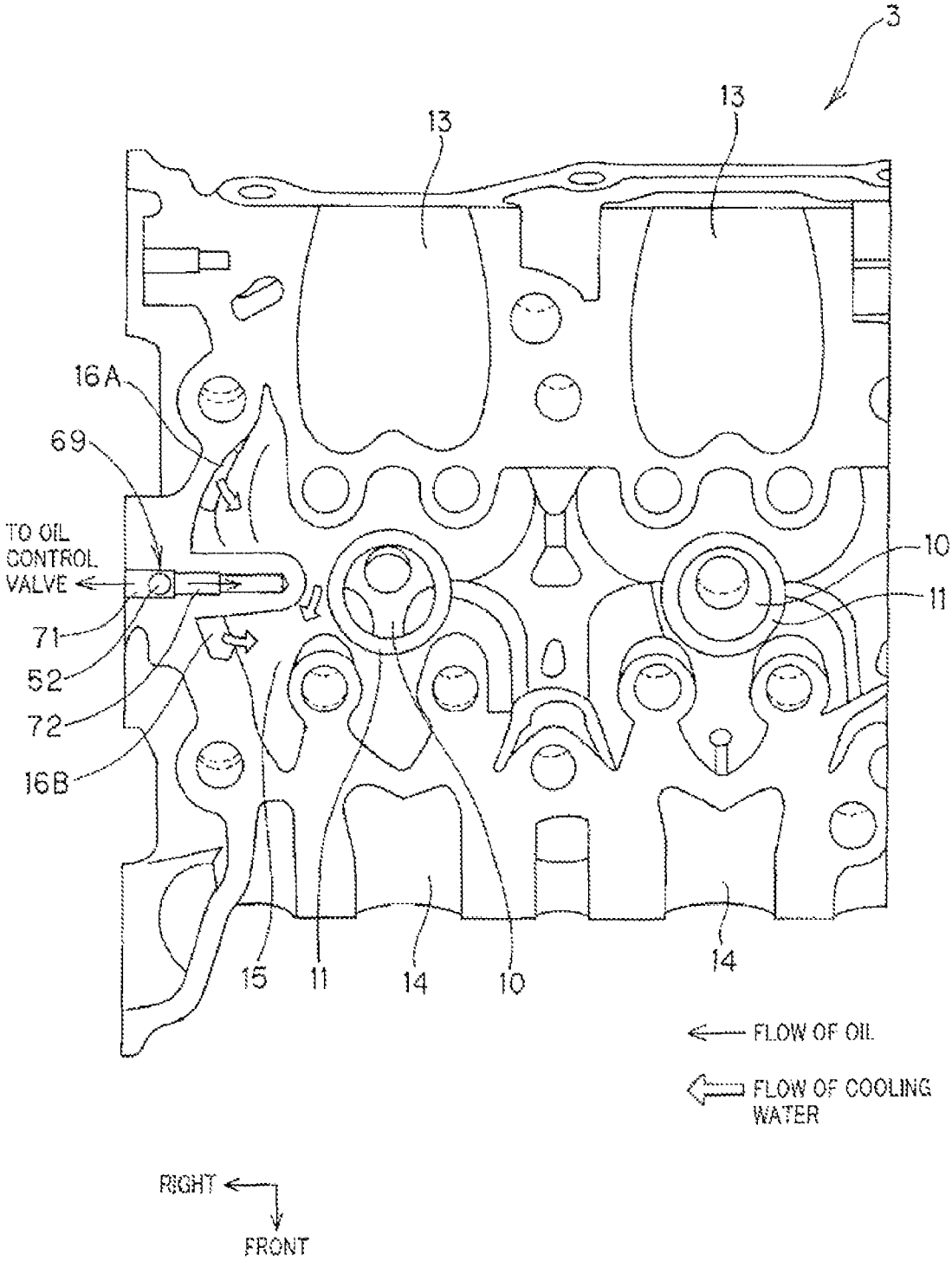
FIG. 5 is a cross-sectional view of a cylinder head according to a first embodiment of the present invention.

As shows in FIG. 5, the cylinder head 3 includes an intake port 13 for respective cylinders formed on an intake side, a rear side, for conducing the intake air to the combustion chambers 9, and an exhaust port 14 for respective cylinders formed on an exhaust side, a front side, for conducting the exhaust gas from the combustion chambers 9.

Further referring to FIG. 1, the cylinder head 3 includes a water jacket 15 around the intake port 13, and a cooling water introducing passage 16 for conducting the cooling water to the water jacket 15. The cooling water introducing passage 16 comprises an intake-side cooling water introducing passage 16A and an exhaust-side cooling water introducing passage 16B.

As shown in FIG. 7, the chain case 7 includes, in an upper part toward the cylinder head 3, a protuberance section 17 formed rearwardly on the intake side, and a depressed section 18 and an engine mount attaching section 19 which are formed forwardly on the exhaust side.

As shown in FIGS. 6 and 7, in an upper side of the cylinder block 2 and in the rearward intake side, a water pump 22 equipped with a water pump pulley 21 is mounted through a water pump mounting section 20. The water pump mounting section 20 includes a pump mounting surface 23, a pump inlet 24, and pump outlet 25. The water pump 22 supplies the cooling water to the cooling water introducing passage 16 in the cylinder head 3.

In the cylinder block 2, an alternator 29 with an alternator pulley 28 is attached rearwardly of the water pump 22, which is supported by an upper alternator arm 26 and a lower alternator arm 27.

As shown in FIGS. 6 and 7, a crankshaft 30 is supported in the cylinder block 2. The crankshaft 30 includes on a right side a crank pulley 31, a trochoid oil pump 32, and a timing sprocket 33. The oil pump 32 is formed by an oil pump plate 34 in a lower part of the chain case 7 and is driven by rotation of the crankshaft 30 to generate the oil pressure.

Also as shown in FIG. 6, the cylinder block 2 includes a main gallery 35 formed in an axial direction X of a camshaft (transversely of the vehicle) for introducing the oil from the oil pump 32. The cylinder block 2 also includes a cylinder block-side oil passage 36 extending upwardly and branched from the main gallery 35.

Further as shown in FIG. 6, at the bottom of the cylinder block 2, an intake pipe 38 equipped with an oil strainer 37 is attached so as to be connected to the oil pump 32.

As shown in FIG. 7, a belt 39 passes around the water pump pulley 21, the alternator pulley 28, and the crank pulley 31.

Figure 4:
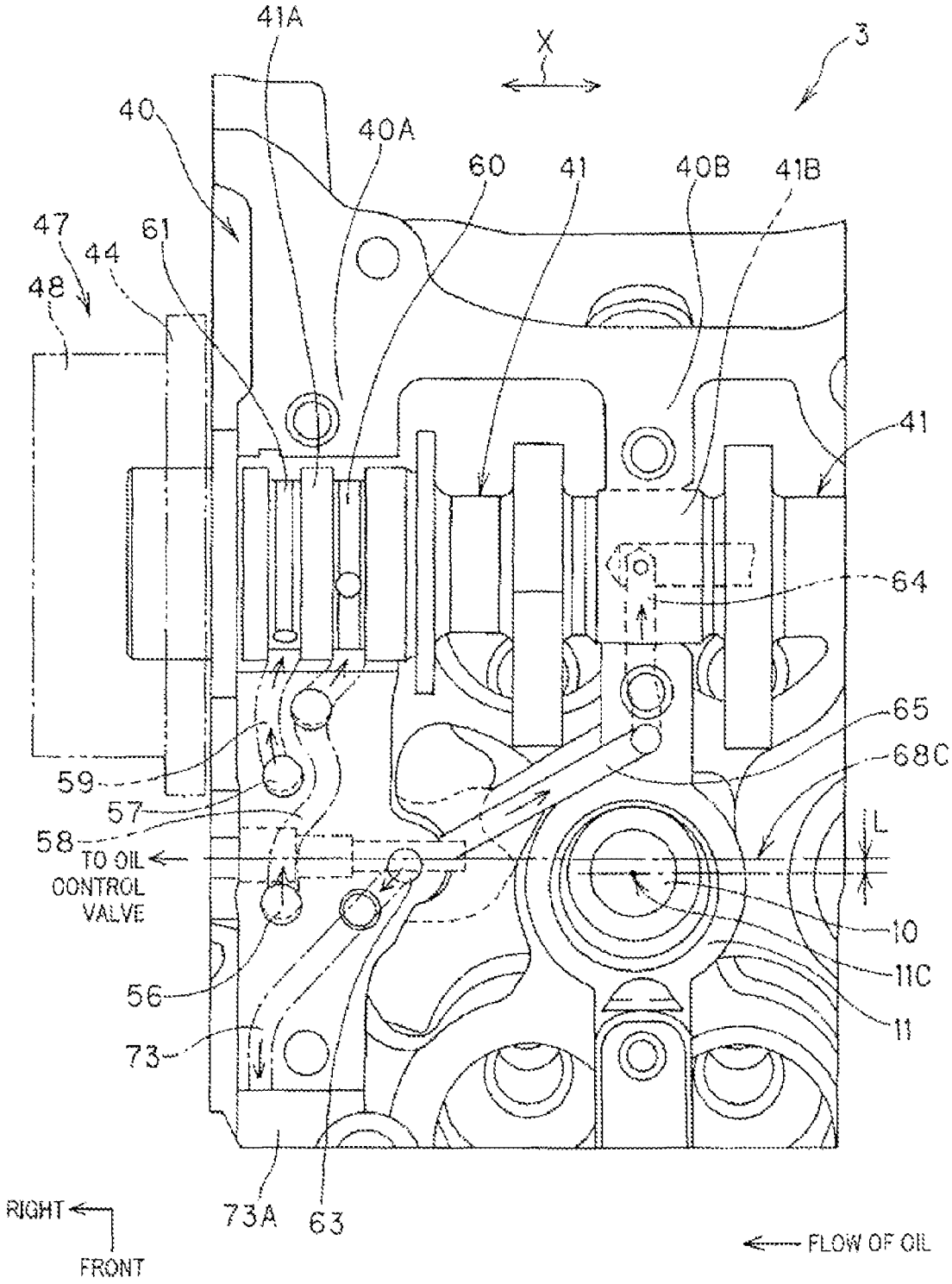
FIG. 4 is a plan view of a cylinder head according to a first embodiment of the present invention.

Referring to FIG. 4, in the upper part of the cylinder head 3, a plurality of camshaft bearing sections 40, i.e. a first camshaft bearing section 40A, a second camshaft bearing section 40B, etc., are arranged in the axial direction X of the camshaft (transverse direction of the vehicle).

Lower portions of the camshafts, an intake camshaft 41 and an exhaust camshaft 42 are rotatably supported by the first camshaft bearing section 40A, the second camshaft bearing section 40B, etc.

As shown in FIG. 1, upper portions of the intake camshaft 41 and the exhaust camshaft 42 are rotatably supported by a plurality of camshaft housings 43, i.e. a first camshaft housing 43A, a second camshaft housing 43B, etc.

As shown in FIG. 6, the intake camshaft 41 has a right end to which an intake camshaft sprocket 44 is attached; the exhaust camshaft 42 has a right end to which an exhaust camshaft sprocket 45 is attached.

In the chain chamber 6, a timing chain 46 passes around the timing sprocket 33, the intake camshaft sprocket 44, and the exhaust camshaft sprocket 45.

Figure 3:
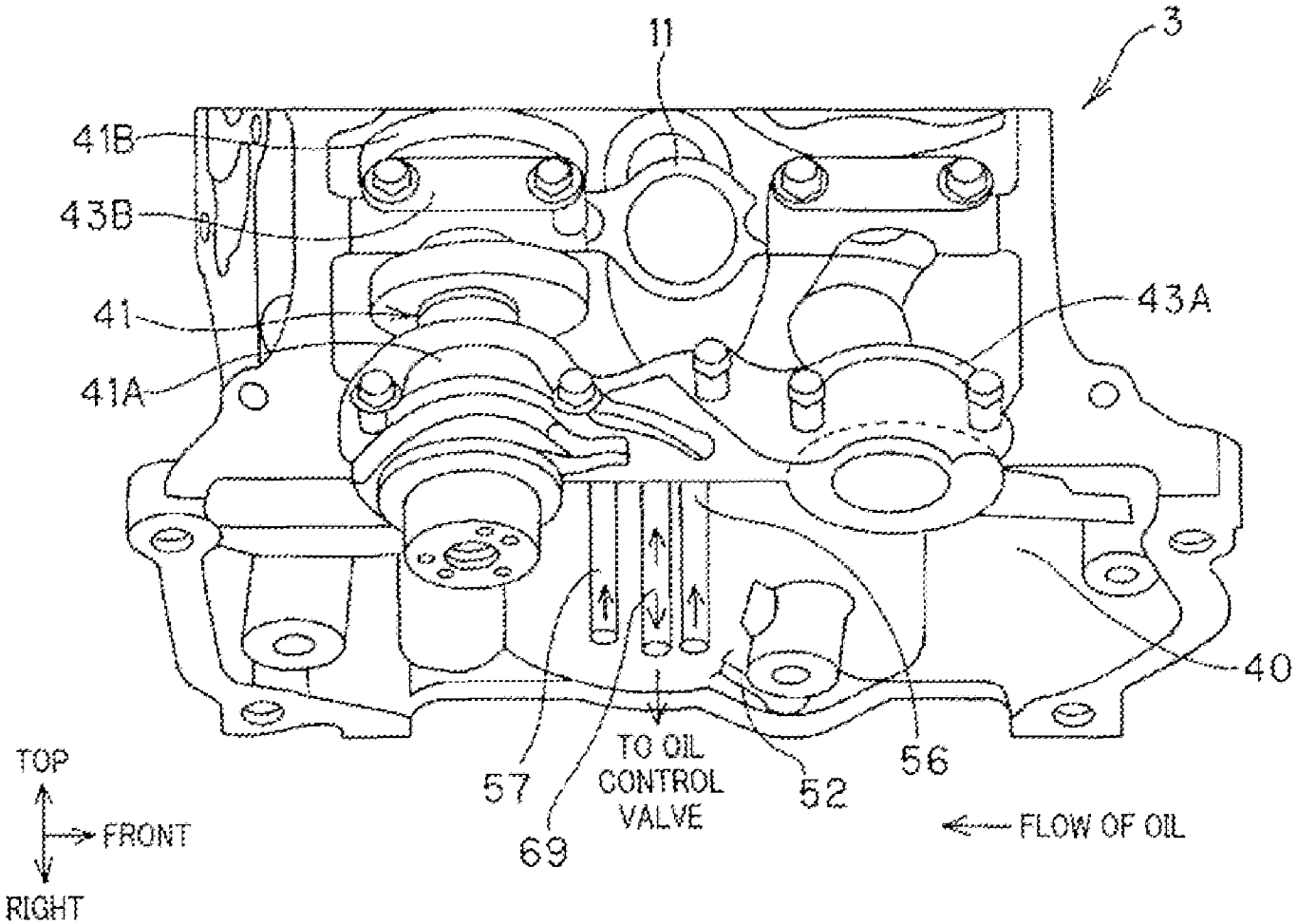
FIG. 3 is a perspective view of a cylinder head according to a first embodiment of the present invention.

Referring to FIGS. 3 and 4, an actuator 48 of a variable valve timing mechanism 47 is attached to the intake camshaft 41 at a portion protruding from the edge wall 8 of the cylinder head 3.

Figure 2:
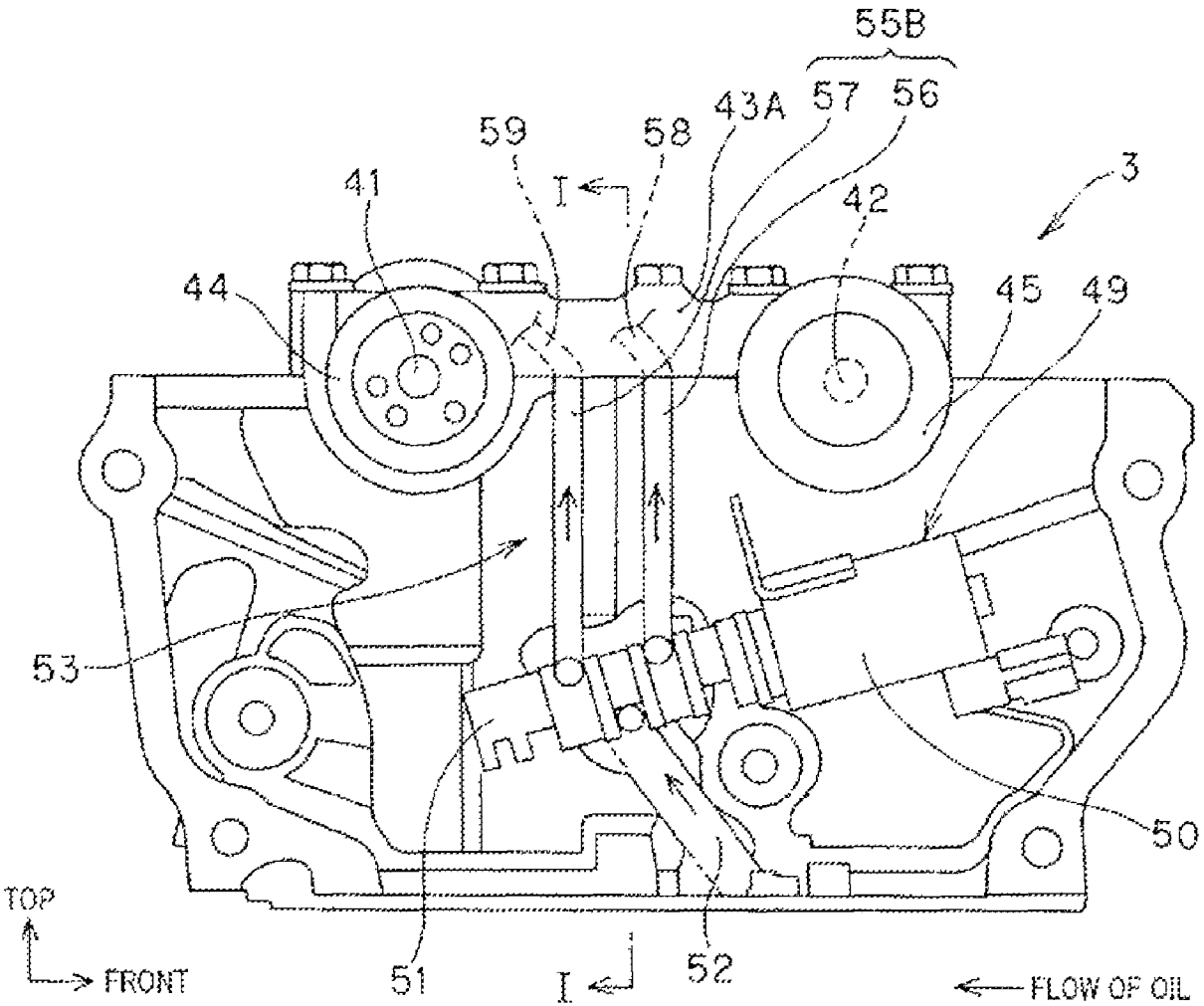
FIG. 2 is a right side view of a cylinder head according to a first embodiment of the present invention.

As shown in FIGS. 2, 6, and 7, an oil control valve 49 of the variable valve timing mechanism 47 is attached to the chain case 7 that covers the edge wall 8 of the cylinder head 3. The oil control valve 49 integrates a solenoid section 50 and a spool portion 51; the spool portion 51 is inserted inner of the chain case 7 from a stepped portion of the depressed section 18 outside the chain case 7, while the solenoid section 50 is positioned in the depressed section 18.

As shown in FIGS. 1 and 6, in the edge wall 8 of the cylinder head 3, a cylinder head-side oil passage 52 is formed by which the oil is supplied from the cylinder block 2 side.

A downstream end of the cylinder head-side oil passage 52 is branched into an actuator oil passage (operating oil path) 53 in communication to the actuator 48 through the oil control valve 49 and a camshaft bearing oil passage (lubrication oil path) 54 in communication to the second camshaft bearing section 40B.

An upstream end of the cylinder-head side oil passage 52 is communicated to the cylinder-block side oil passage 36 of the cylinder block 2.

As shown in FIG. 1, in the edge wall 8 of the cylinder head 3, the actuator oil passage 53 includes a valve upstream-side passage section 55A communicating between the cylinder head-side oil passage 52 and the oil control valve 49, and a valve downstream-side passage section 55B communicating between the oil control valve 49 and the first camshaft bearing section 40A that is positioned above the edge wall 8 of the cylinder head 3.

As shown in FIGS. 2, 3, and 6, the valve downstream-side passage section 55B includes a valve timing retard passage 56 and a valve timing advance passage 57, which extend upwardly for introducing the oil from the oil control valve 49 to the actuator 48 side.

Also as shown in FIG. 2, a camshaft housing retard passage 58 in communication to the valve timing retard passage 56, and a camshaft housing advance passage 59 in communication to the valve timing advance passage 57 are formed in the first camshaft housing 43A.

Further, as shown in FIG. 4, an end journal 41A, or a first camshaft journal at a right end of the intake camshaft 41 includes an end journal retard passage 60 in communication to the camshaft housing retard passage 58, and an end journal advance passage 61 in communication to the camshaft housing advance passage 59. In the end journal 41A, only the actuator oil passage 53 is therefore formed. Thereby, the structure can be simplified.

The end journal retard passage 60 is communicated to a retard chamber of the actuator 48; the end journal advance passage 61 is communicated to an advance chamber of the actuator 48.

Referring to FIG. 1, the cylinder head-side oil passage 52 and the second camshaft bearing section 40B adjacent to the first camshaft bearing section 40A in the axial direction of the intake camshaft 41 are communicated by a communication oil passage 66 of a communication passage section 65 as the camshaft bearing oil passage 54.

The communication oil passage 66 is communicated to a second camshaft housing lubricating passage 64B formed in the second camshaft housing 43B supporting the second camshaft journal 41B of the intake camshaft 41. In addition, the communication oil passage 66 is formed inward of the water jacket 15.

As shown in FIG. 1, the cylinder head 3 includes a partition wall 67 which separates the upward valve operating chamber 12 from the downward water jacket 15.

Also, in the edge wall 8 of the cylinder head 3 in a section lower than the partition wall 67, a boss section 68 of a certain area is formed which has one end joined to the chain case 7 and the other end protruding into the water jacket 15. The boss section 68 is formed to protrude into the water jacket 15 so as to permit proper flow of the cooling water in the water jacket 15.

Within the boss section 68, a branch oil passage 69 is formed which linearly extends into the water jacket 15 from the joining surface 8A with the chain case 7 and which has an intermediate portion to which the cylinder head-side oil passage 52 is connected. The branch oil passage 69 extends to the vicinity of the combustion chamber 9 of the water jacket 15, that is adjacent to the ignition plug hole 10.

The branch oil passage 69 toward the chain case 7 with respect to a junction with the cylinder head-side oil passage 52 forms the valve upstream-side passage section 55A.

Also, an end section of the branch oil passage 69 protruding into the water jacket 15 and a camshaft cap coupling surface 70 of the second camshaft bearing section 40B are communicated by the linear communication passage section 65.

Referring to FIG. 4, when viewing the cylinder head 3 from a side of a mounting surface 4A of the cylinder head cover 4, a centerline 68C of the boss section 68 is offset with respect to a center 11C of the ignition plug hole wall 11 by a distance L in a direction perpendicular to the axial direction X of the camshaft (in the longitudinal direction of the vehicle) toward the axis of the intake camshaft 41 to which the actuator 48 is attached.

Referring to FIG. 1, the branch oil passage 69 is formed in a stepped shape by a first branch oil passage 71 and a second branch oil passage 72; a diameter D2 of the second branch oil passage 72 at the junction with the communication oil passage 66 is reduced with respect to a diameter D1 of the first branch oil passage 71 at the junction with the cylinder head-side oil passage 52.

The first branch oil passage 71 is communicated to the oil control valve 49 through a case oil passage of the chain case 7.

In this connection, as shown in FIGS. 1 and 4, a camshaft bearing lubrication passage 63 that extends upwardly is connected to the second branch oil passage 72 at a center portion in the axial direction thereof; the camshaft bearing lubrication passage 63 is communicated to an exhaust camshaft bearing section 73A that supports the exhaust camshaft 42 thorough a first camshaft housing lubricating passage 73 that is formed in the first camshaft housing 43A.

As shown in FIG. 6, the timing chain 46 is maintained under a certain tension by a forward chain guide 74 and a rearward tensioner mechanism 77 including a chain tensioner 75 and a tensioner arm 76.

Operation of the first embodiment of the present invention is explained as follows.

The oil in the oil pan 5 is sucked by the driven oil pump 32 through the oil strainer 37, and is pumped to the main gallery 35 in the cylinder block 2.

The oil in the main gallery 35 is introduced through the cylinder block-side oil passage 36 to the cylinder head-side oil passage 52 in the cylinder head 3.

The oil having been introduced to the cylinder head-side oil passage 52 is branched by the branch oil passage 69 into the actuator oil passage 53 for conducing the oil toward the chain case 7 and the camshaft bearing oil passage 54 for conducting the oil toward the first and second camshaft bearing sections 40A, 40B of the cylinder head 3.

The oil having been introduced to the actuator oil passage 53 is divided by the oil control valve 49 into the valve timing retard passage 56 and the valve timing advance passage 57.

The oil is then introduced to the retard chamber and the advance chamber of the actuator 48 for the variable valve timing mechanism 47 through the end journal advance passage 60 and the end journal advance passage 61 of the end journal 41A of the intake camshaft 41 so as to change the timing of valve operations.

On the other hand, the oil having been introduced to the camshaft bearing oil passage 54 is introduced to the second camshaft journal 41B of the intake camshaft 41 through the communication oil passage 66 and the second camshaft housing lubricating oil passage 64B in the second camshaft housing 43B.

Further, some of the oil having been introduced to the camshaft bearing oil passage 54 is introduced to the camshaft bearing section 73A toward the exhaust camshaft 42 through the camshaft bearing lubrication passage 63 and the first camshaft housing lubricating oil passage 73 in the first camshaft housing 43A.

Thereby, the lubricating oil path for the intake camshaft 41 to which the actuator 48 of the variable valve timing mechanism 47 is attached is guided to the second camshaft journal 41B of the intake camshaft 41 by the branch oil passage 69 that extends inside the water jacket 15 of the cylinder head 3 and by the communication oil passage 66, which simplifies the structure of the oil passage.

Also the branch oil passage 69 extends to the vicinity of the combustion chamber 9 of the water jacket 15, i.e. adjacent to the ignition plug hole 10, which brings the flow of the cooling water to the vicinity of the combustion chamber 9, in particular the ignition plug hole wall 11, when the cooling water introduced by the water pump 22 on the intake side flows toward the exhaust side.

More particularly, according to the first embodiment of the present invention, in the cylinder head 3 equipped with the variable valve timing mechanism 47, the end journal 41A of the intake camshaft 41 is provided with only the actuator oil passage 53 for the actuator 48 of the variable valve timing mechanism 47; the camshaft bearing oil passage 54 has the communication oil passage 66 formed inward of the water jacket 15 in the cylinder head 3 for conducting the oil to the second camshaft journal 41B. Thereby, the camshaft bearing oil passage 54 is simplified while fully obtaining the operating oil pressure for the variable valve timing mechanism 47, reducing the number of components and allowing the cylinder head 3 to be made smaller in size to downsize the engine 1 and promote productivity. Also the boss section 68 having the branch oil passage 69 therein provides proper flow of the cooling water in the cylinder head 3 to improve coolability of the combustion chamber 9 in the cylinder head 3.

While the first embodiment of the present invention has been explained above, the constitution of this embodiment is applied to each claim as follows.

Firstly, the present invention provides the partition wall 67 which separates the upward valve operating chamber 12 from the downward water jacket 15; in the edge wall 8 of the cylinder head 3 in the section lower than the partition wall 67, the boss section 68 of the certain area is formed to protrude into the water jacket 15, which has one end joined to the chain case 7 and the other end protruding into the water jacket 15; within the boss section 68, the branch oil passage 69 is formed which linearly extends into the water jacket 15 from the joining surface 8A with the chain case 7 and which has the intermediate portion to which the cylinder head-side oil passage 52 is connected; and the valve upstream-side passage section 55A is specified by the section of the branch oil passage 69 toward the chain case 7 with respect to the junction of the branch oil passage 69 and the cylinder head-side oil passage 52. Also, the end section of the branch oil passage 69 protruding into the water jacket 15 and the camshaft cap coupling surface 70 of the second camshaft bearing section 40B are communicated by the linear communication passage section 65.

By such constitution, the valve upstream-side passage section 55A that is upstream of the actuator oil passage 53 and the upstream section of the camshaft bearing oil passage 54 are integrated into the branch oil passage 69 extending linearly into the boss section 68, which simplifies the oil passage structure of the cylinder head 3.

In addition, the branch oil passage 69 is positioned at the lower level than the partition wall 67 that separates the valve operating chamber 12 in the cylinder head 3 from the water jacket 15, and the branch oil passage 69 protrudes into the water jacket 15, so that the camshaft cap coupling surface 70 of the second camshaft bearing section 40B and the inner edge section of the branch oil passage 69 can be communicated by the linear communication passage section 65, which simplifies the structure of the camshaft bearing oil passage 54.

Further, this may decrease the possibility of fall or deterioration of working tools from a perpendicular direction to the camshaft cap coupling surface 70 when shaping the communication oil passage 66, which promotes workability.

Also the branch oil passage 69 and the communication oil passage 66 protrude into the water jacket 15, which simplifies the oil passage structure formed in the upper part of the edge wall 8 of the cylinder head 3 and allows the cylinder head 3 to be made smaller in size to promote the productivity.

Moreover, the boss section 68 causes the cooling water, which is introduced from the cooling water introducing passage 16 of the cylinder head 3 adjacent to the water pump 22 and flows in the direction perpendicular to the rows of the cylinders (in the longitudinal direction of the vehicle), to be deviated toward the center of the combustion chamber 9, which enhances the cooling effect at the center of the combustion chamber 9.

According to the invention defined in claim 2, when viewing the cylinder head 3 from the side of the mounting surface 4A of the cylinder head cover 4, the centerline 68C of the boss section 68 is offset with respect to the center of the ignition plug hole wall 11 in the direction perpendicular to the axial direction X of the camshaft (in the longitudinal direction of the vehicle) toward the axis of the intake camshaft 41 to which the actuator 48 is attached.

Thereby, the communication passage section 65 can be positioned adjacent to the ignition plug hole wall 11 in the axial direction X of the camshaft, which reduces the longitudinal dimension of the cylinder head 3 and reduces the entire length of the communication oil passage 66, promoting the workability and improving the productivity of the cylinder head 3.

According to the invention defined in claim 3, the branch oil passage 69 is formed in the stepped shape; the diameter of the branch oil passage 69 at the junction with the communication oil passage 66 is reduced with respect to the diameter of the passage at the junction with the cylinder head-side oil passage 52.

This is intended to enhance responsivity of the actuator 48 of the variable valve timing mechanism 47 by reducing the diameter of the branch oil passage 69 on a joint side of the communication oil passage 66 so as to supply more oil through the actuator oil passage 53. Also, thanks to the structure of the present invention, the actuator oil passage 53 can be made greater in diameter than the camshaft bearing oil passage 54 merely by processing the branch oil passage 69 by using the cutting tools in a stepped shape, which promotes the productivity of the cylinder head 3.

DETAILED DESCRIPTION OF A SECOND EMBODIMENT OF THE INVENTION

Figure 8:
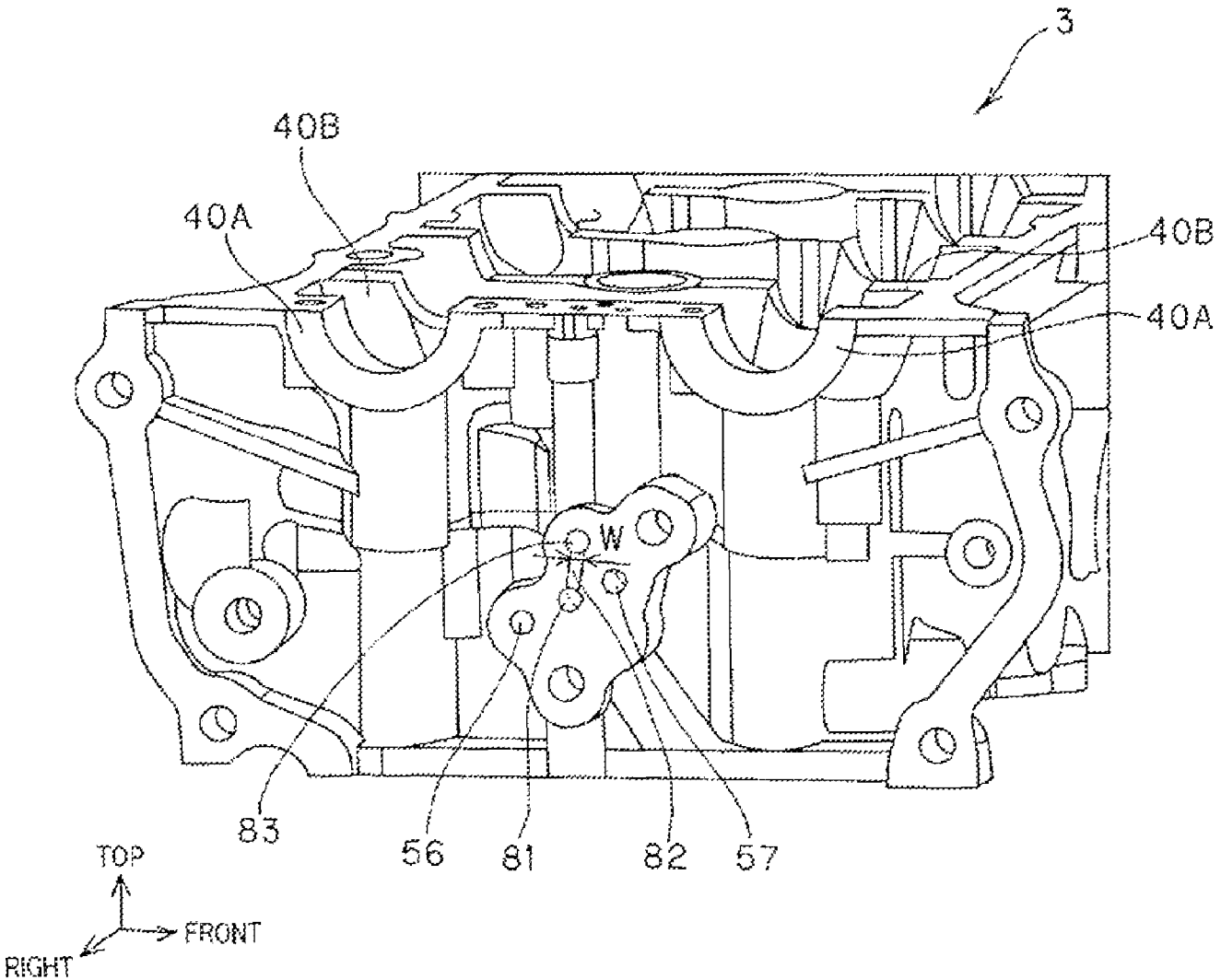
FIG. 8 is a perspective view of a cylinder head according to a second embodiment of the present invention.

FIG. 8 illustrates a second embodiment of the present invention.

In the second embodiment, the elements identical or similar to the first embodiment are designated by the same reference numbers.

The second embodiment of the present invention is characterized as follows. In the edge wall 8 of the cylinder head 3, a branch oil passage 81 is formed which is communicated to the cylinder head-side oil passage 52 and which conducts the oil toward the oil control valve 49; a camshaft bearing oil groove 82 is formed which is communicated to the branch oil passage 81; and a camshaft bearing oil passage 83 is formed which is communicated to the camshaft bearing oil groove 82. The camshaft bearing oil groove 82 is formed to have a certain area in a width W, and functions as a throttling valve to restrict the oil required for lubricating the camshaft. The camshaft bearing oil groove 83 is formed within the water jacket 15 of the cylinder head 3.

In the edge wall 8 of the cylinder head 3, the valve timing retard passage 56 and the valve timing advance passage 57 are formed for conducting the oil from the oil control valve 49 toward the actuator 48.

According to the second embodiment, the oil pumped from the cylinder block 2 is introduced to the branch oil passage 81, and is divided at the control valve 49 into the valve timing retard passage 56 and the valve timing advance passage 57. Also, the oil pumped from the cylinder block 2 is introduced through the camshaft bearing oil groove 82 to the camshaft bearing oil passage 83. At this moment, the flow rate of the oil for the camshaft bearing is restricted by the camshaft bearing oil groove 82.

Thereby, the camshaft bearing oil groove 82 functioning as conventional throttling valve eliminates the need for the throttling valve, reducing the number of components and simplifying the structure.

INDUSTRIAL APPLICABILITY

The present invention is illustrated for the cylinder head structure equipped with the variable valve timing mechanism. However, the present invention can be applied to the cylinder head using common materials without the variable valve timing mechanism, which is devoid of processing of oil passage such as the valve timing retard passage, the valve timing advance passage, and the camshaft bearing lubrication path.

EXPLANATION OF REFERENCE NUMERALS

1—engine;
2—cylinder block;
3—cylinder head;
4—cylinder head cover;
5—oil pan;
7—chain case;
9—combustion chamber;
10—ignition plug hole;
11—ignition plug hole wall;
22—water pump;
32—oil pump;
35—main gallery;
40—camshaft bearing section;
41—intake camshaft;
42—exhaust camshaft;
43—camshaft housing;
47—variable valve timing mechanism;
48—actuator;
49—oil control valve;
52—cylinder head-side oil passage;
53—actuator oil passage;
54—camshaft bearing oil passage;
55A—valve upstream-side passage section;
55B—valve downstream-side passage section;
56—valve timing retard passage,
57—valve timing advance passage;
63—camshaft bearing lubrication passage;
65—communication passage section;
66—communication oil passage;
67—partition wall;
68—boss section;
69—branch oil passage;
70—camshaft cap coupling surface; and
73—exhaust camshaft bearing lubrication passage.

What is claimed is:

1. A structure of a cylinder head of an engine, comprising:

more than one camshaft bearing section formed on top of the cylinder head and arranged in an axial direction of a camshaft, the camshaft bearing section rotatably supporting the camshaft;

an actuator of a variable valve timing mechanism attached to the camshaft at a protruding section from an edge wall of the cylinder head;

an oil control valve disposed in a chain case that covers the edge wall of the cylinder head;

a cylinder head-side oil passage formed in the edge wall of the cylinder head by which oil is supplied from the cylinder block side, the cylinder head-side oil passage having a downstream end branched into an actuator oil passage in communication to the actuator through the oil control valve and a camshaft bearing oil passage in communication to the camshaft bearing section;

a valve upstream-side passage section formed in the edge wall of the cylinder head as the actuator oil passage for communicating between the cylinder head-side oil passage and the oil control valve;

a valve downstream-side passage section for communicating between the oil control valve and a first camshaft bearing section above the edge wall of the cylinder head;

a communication passage section as the camshaft bearing oil passage for communicating the cylinder head-side oil passage with a second camshaft bearing section adjacent to the first camshaft bearing section in the axial direction of the camshaft, comprising the improvement wherein a partition wall is disposed in the cylinder head to separate an upward valve operating chamber from a downward water jacket;

a boss section is formed at a position lower than the partition wall in the edge wall of the cylinder head, and has one end joined to the chain case and the other end protruding into the water jacket;

a branch oil passage is formed in the boss section and extends linearly into the water jacket from a joint surface with the chain case, and has a middle section to which the cylinder head-side oil passage is connected, the branch oil passage having the valve upstream-side passage section specified by a section toward the chain case with respect to a junction with the cylinder head-side oil passage; and the linear communication passage section communicates between an end portion of the branch oil passage protruding into the water jacket and a camshaft cap coupling surface of the second camshaft bearing section.

2. The structure of the cylinder bead of the engine according to claim 1, wherein when viewing the cylinder head from the side of a mounting surface of a cylinder head cover, a centerline of the boss section is offset with respect to a center of an ignition plug hole wall in the direction perpendicular to an axial direction of the camshaft toward an axis of the camshaft to which the actuator is attached.

3. The structure of the cylinder head of the engine according to claim 1, wherein the branch oil passage is formed in a stepped shape, a diameter of the branch oil passage at a junction with the communication passage section is reduced with respect to a diameter of the passage at a junction with the cylinder head-side oil passage.

* * * * *

UNITED STATES PATENT AND TRADEMARK OFFICE

CERTIFICATE OF CORRECTION

PATENT NO. : 7,717,081 B2
APPLICATION NO. : 11/876392
DATED : May 18, 2010
INVENTOR(S) : Yamada It is certified that error appears in the above-identified patent and that said Letters Patent is hereby corrected as shown below:

Column 10, line 50, delete "bead" and insert therefor --head--.

Signed and Sealed this

Twenty-ninth Day of June, 2010

David J. Kappos

David J. Kappos
*Director of the United States Patent and Trademark Office*